US006263865B1

(12) United States Patent
Koyama et al.

(10) Patent No.: US 6,263,865 B1
(45) Date of Patent: Jul. 24, 2001

(54) COMBUSTION PROMOTING DEVICE

(76) Inventors: Motonari Koyama; Kumiko Koyama, both of 14 -21 Ikurahonmachi, Shimonoseki-City 751-0863 (JP)

( * ) Notice: Subject to any disclaimer, the term of this patent is extended or adjusted under 35 U.S.C. 154(b) by 0 days.

(21) Appl. No.: 09/504,859

(22) Filed: Feb. 16, 2000

(30) Foreign Application Priority Data

Feb. 16, 1999 (JP) ..... 11-37753
Feb. 16, 2000 (JP) ..... 12-38392

(51) Int. Cl.[7] ..... F02M 33/00
(52) U.S. Cl. ..... 123/536; 123/537; 123/539
(58) Field of Search ..... 123/536, 537, 123/538, 539

(56) References Cited

U.S. PATENT DOCUMENTS 5,111,797 * 5/1992 Shikanai ..... 123/537
6,026,788 * 2/2000 Wey ..... 123/538
6,058,914 * 5/2000 Suzuki ..... 123/538
6,082,339 * 7/2000 Wey ..... 123/538

* cited by examiner

*Primary Examiner*—Marguerite McMahon
(74) *Attorney, Agent, or Firm*—Kubovcik & Kubovcik

(57) ABSTRACT

A combustion promoting device. The device, which includes a heat resistant substrate with ceramic and titanium oxide attached thereto, disperses ionized clusters of cohering atoms or molecules charged with electricity and makes said ionized clusters into fine particles. The ionized clusters constitute a combustible fluid to be supplied into combustion equipment and to cause a combination reaction. This combustion promoting devise enhances the combustion efficiency in combustion equipment and thereby reduces the content of such harmful substances an NOx, SOx and HC in the exhaust gas and increases the life of the combustion equipment.

3 Claims, 3 Drawing Sheets

COMBUSTION PROMOTING DEVICE

FIELD OF THE INVENTION

The present invention relates to a combustion promoting device and a method for using it, and in particular, for example, to a combustion promoting device for enhancing combustion efficiency in a combustion equipment such as an internal combustion engine and thereby improving fuel economy and reducing harmful substances such as NOx, SOx, HC (hydrocarbon) contained in the exhaust gas, and a method for using it.

DESCRIPTION OF THE PRIOR ART

A gasoline engine, taken up by way of example as one of internal combustion engines, is generally constructed to obtain power through crankshaft rotation caused by the force of a piston moving toward the bottom portion of a cylinder, in which atomized gasoline and air are at the same time delivered into a combustion chamber of the engine and sparked by a plug so as to react explosively.

In this case, the air supplied through an air intake duct into this combustion chamber streams successively in ionized clusters, bodies of cohering atoms or molecules of nitrogen and oxygen charged with positive or negative electricity.

Since the air thus delivered into the combustion chamber is in a cohering phase formed by multiple and successive ionized clusters, the fuel combustion efficiency cannot be enhanced so much even if the atomized fuel and the oxygen as a component accounting for 21% of the air are brought into an explosive reaction in the combustion chamber.

This is because adjacent clusters of oxygen which partly form the cohering phase are united through the ionic bond. Accordingly the active degree of this oxygen, which may be regarded as a scale of combustibility, is reduced. Therefore the atomized fuel cannot burn well. As a result, there occurs an incomplete combustion of such additives in the gasoline as benzene, aldehyde, antioxidant and anti-freezing agent, and a comparatively large amount of black smoke is produced, which is one of the causes of air pollution.

SUMMARY OF THE INVENTION

Considering this situation, the inventor focused attention on positive ions emitted from ceramic and titanium oxide. That is, he found out that the fuel combustion efficiency can be enhanced when these positive ions succeed in neutralizing ionized clusters of oxygen in the air delivered into the combustion chamber and thereby in dispersing and making the ionized clusters into fine particles, and completed the present invention.

The object of the present invention is to provide a combustion promoting device for enhancing the combustion efficiency in a combustion equipment and thereby reducing the content of such harmful substances as NOx, SOx, HC in the exhaust gas and for making the life of the combustion equipment longer and a method for using the device.

Further, when the combustion equipment is an internal combustion engine, the object is to provide a combustion promoting device which can improve fuel economy and increase power and a method for using the device.

An embodiment of the present invention relates to a combustion promoting device comprising a heat resistant substrate with ceramic and titanium oxide attached thereto for dispersing ionized clusters of cohering atoms or molecules charged with electricity and for making said ionized clusters into fine particles, said ionized clusters constituting a combustible fluid to be supplied into a combustion equipment and to cause a combustion reaction.

There is no restriction to the substrate material, so long as it is heat-resistant. For example, a cloth of glass fiber (woven fabric, nonwoven fabric, knit fabric) may be employed. The material is preferably heat-resistant above 100° C. The substrate is not limited to this type of cloth. For example, the substrate may be formed into a lump. Furthermore, the substrate may be formed into a granule having a predetermined diameter or fine powder. The substrate may be liquid filled in a bag or a container.

Combustion equipment may include various combustion apparatus (boiler, stove, etc.), various internal combustion engines (gasoline engine, diesel engine, propane gas engine, jet engine, etc.) and a thermal power electric generator. Running vehicles with any of these internal combustion engines installed may include a passenger car, a truck, a bus, an auto-bicycle. Various other special utility vehicles (forklift truck, truck crane, shovel loader), a ship, an airplane may also be included.

Combustible fluids may include gasoline, light oil, kerosene, heavy oil, propane, jet fuel. Examples of other fluids are air used during the combustion and cooling water.

There is no particular restriction to the ceramics for dispersing and making ionized clusters into fine particles. Examples of such various semi-conductive substances, carbide, nitride, and boride may include alumina, feldspar, silica, granite, steatite, mica, soda glass, cordierite, barium titanate, potassium niobate, strontium titanate, barium stannate, silicon carbide, molybudenum silicide, lanthanum chromite, zirconia, zircon, chromia, aluminum oxide, silicon nitride, aluminum nitride, gallium arsenide, beryllia, glass ceramic, mullite, ferrite.

These ceramics are classified by their functions as below.

(1) Electrically functional ceramics include such examples as a) highly insulating ceramic; $Al_2O_3$, b) highly capacitive ceramic; $BaTiO_3$, c) piezoelectric ceramic; PZT, $SiO_2$, ZnO, d) semiconductive ceramic; $LaCrO_3$, SiC, iron family oxide, $BaTiO_3$, vanadium oxide, ZnO-$Bi_2O_3$, $SnO_2$, e) ion conductive ceramic; β-$Al_2O_3$, $ZrO_2$, f) thermion emitting ceramic; $LaB_6$, g) secondary electron emitting ceramic; $BaTiO_3$.

(2) Magnetically functional ceramics include such examples as a) soft magnetic ceramic; Zn-Mn ferrite, γ-$Fe_2O_3$, YIG, b) hard magnetic ceramic; SrO, $6Fe_2O_3$.

(3) Optically functional ceramics include such examples as a) light translucent ceramic; sintered $Al_2O_3$, b) light conductive ceramic; $SiO_2$ fiber, ZnO thin plate, c) reflective ceramic; $SnO_2$, $In_2O_3$, TiN, d) ceramic excited by X-ray/ultra violet ray; $CaWO_4$, e) ceramic excited by infrared ray; $LaF_3$ (including Yb, Er), f) ceramic excited by electron; $Y_2O_2S$ (including Eu), ZnS (including Al, Cl), g) ceramic for laser; $Al_2O_3$ (including Cr), $Y_3Al_5O_{12}$ (including Nd), h) light emitting diode; GaAs (including Si), i) electroluminescent ceramic; ZnS (including Cu, Al), j) electro-optically effective ceramic; $Bi_4(GeO_4)_3$, PLZT, k) magneto-optically effective ceramic; YIG, l) acousto-optically effective ceramic; $LiTaO_3$, $LiNbO_3$, m) nonlinear-optically effective ceramic; $Ba_2NaNb_5O_{15}$.

(4) Thermally functional ceramics include such examples as a) heat resistant ceramic; $ThO_2$, $ZrO_2$, b) heat insulating ceramic; $K_2O{\bullet}nTiO_2$, $CaO{\bullet}nSiO_2$, c) heat transmitting ceramic; BeO, diamond.

(5) Mechanically functional ceramics include such examples as a) hard ceramic; $Al_2O_3$, WC, TiC, $B_4C$, SiC, diamond, b) load bearing ceramic; $Si_3NO_4$, SiC, reinforced glass, crystallized glass.

(6) Biologically or chemically functional ceramics include such examples as a) bio-ceramic or artificial bone; $Ca_5(F, Ci)P_3O_{12}$, $Al_2O_3$, b) immobilized enzyme carrier ceramic; $SiO_2$, $Al_2O_3$, c) catalytic carrier ceramic; $Al_2O_3$, $TiO_2$, d) catalytic ceramic; $K_2O \cdot nAl_2O_3$, ferrite.

(7) Ceramics for nuclear reactor fuel include such examples as uranium oxide, uranium carbide, uranium nitride ceramics (ceramic fuel).

As said titanium oxide, for example, TiO2 may be employed.

How to attach ceramic and titanium oxide to a substrate is not restricted to that described above. For example, these materials may be ground into fine powder and may be bonded onto the surface of this substrate with a binder of bonding agent. It may also be applied onto the substrate surface by spraying or may be impregnated into the substrate in some proper method. Further a lump of ceramic or titanium oxide may be attached onto the substrate surface or into the substrate.

Another effects of better fuel economy and higher power can be obtained by providing aluminum to the substrate. Another effect of drastically reducing smoke (black smoke), NOx, and HC in the exhaust gas can be obtained by providing copper to the substrate.

In addition to that, the effect of the present invention can further be enhanced when activated water whose cluster of water molecule is made finer is sprayed to this combustion promoting device.

There is no particular restriction to where to install a combustion promoting device in a combustion equipment. For example, the combustion promoting device may be installed in a storage tank for various combustible fluids, in a supply system to the combustion equipment for the combustible fluids, in a combustion chamber or in an exhaust system downstream of said combustion chamber.

There is no particular restriction to where to install a combustion promoting device in an induction system of an internal combustion engine. For example, the device may be installed on the outer or inner surface of an air intake duct, or may be formed into a predetermined shape of a filter or a small lump to be attached inside the duct.

Such a means as a heat resistant bonding agent, an adhesive tape (single-faced), a double-faced adhesive tape may be employed for sticking a combustion promoting device to the induction system. As a heat resistant tape, for example, a ceramic tape may be employed which is flexibly solidified out of paste of organic urethane emulsion base kneaded with a proper amount of ceramic power. Besides them, other attaching means may be employed, for example, a fastener such as a heat resistant string or a wire, male/female mating surfaces for tight fit between the induction system and the device, or a catcher such as a hook.

The combustion device may detachably be attached to this induction system or may be fixed thereto so as not to easily separate therefrom When a diesel engine is employed as an internal combustion engine, positive ions emitted from ceramic and titanium oxide may act not only on air as described above but also act on engine cooling water. This makes ionized clusters of molecule of the engine cooling water into fine particles and thereby enhances cooling efficiency.

According to the present invention, positive ions emitted from ceramic and titanium oxide neutralizes ionized clusters of various atoms and molecules constituting a combustible fluid for a combustion equipment. This neutralization allows these ionized clusters to be dispersed and made into fine particle, and thereby enhances the combustion efficiency of the combustion equipment. Consequently, the content of such harmful substances as NOx, SOx, HC in the exhaust gas is reduced and the life of the combustion equipment is also made longer.

According to an embodiment of the present invention, when a combustible fluid is attached to an induction system whose downstream end is connected to a combustion chamber, ionized clusters in the air passing through the induction system are neutralized by positive ions emitted from ceramic and titanium oxide. As a result of this neutralization, the ionized clusters of atoms and molecules constituting the air, especially the ionized clusters of oxygen which reacts with fuel during the combustion reaction are dispersed and made into fine particles, and consequently the combustion efficiency is enhanced and the fuel economy and the power of the internal combustion engine are improved.

The above mechanism will be detailed below. Since the combustion promoting device has at its core a special ceramic, which emits super electromagnetic wave and is covered with specially-processed glass fiber, it operates as follows. The molecules of oxygen, nitrogen, and the like in the air do not exist independently by themselves, but multiple molecules link together like a chain through ionic bond. This prevents a complete combustion in an internal combustion engine. Therefore a complete combustion can be achieved by loosening this ionic bond and separating the molecules one another. Here the special ceramic emits a faint electromagnetic wave, and when the wave strikes various metals, positive ions are produced. This positive ion discharges its electron and neutralizes the negative ion of oxygen in the fluid (intake air) and thereby inhibits ionic reactive function. Since this combustion promoting device also emits faint magnetism, oxygen as magnetic substance is dispersed so as to align quickly with each other in the direction of line of magnetic force. As a total result of these actions, for example, negative ions (oxygen) in an air cleaner are discharged and neutralized, and the cohering fluid of oxygen is made into a faintly magnetized fluid which is finely dispersed. Consequently, a negative pressure is produced at an air intake portion, and an effective combustion of fuel can be achieved. Consequently, the content of harmful constituents in the exhaust gas is reduced, the black smoke is also reduce, the fuel economy is improved, and the power is increased.

DESCRIPTION OF THE PREFERRED EMBODIMENTS

A combustion promoting device of an embodiment according to the present invention and a method for using it will hereafter be described. A gasoline engine, that is, one of internal combustion engines, is described as an example of a combustion equipment.

Figure 1:
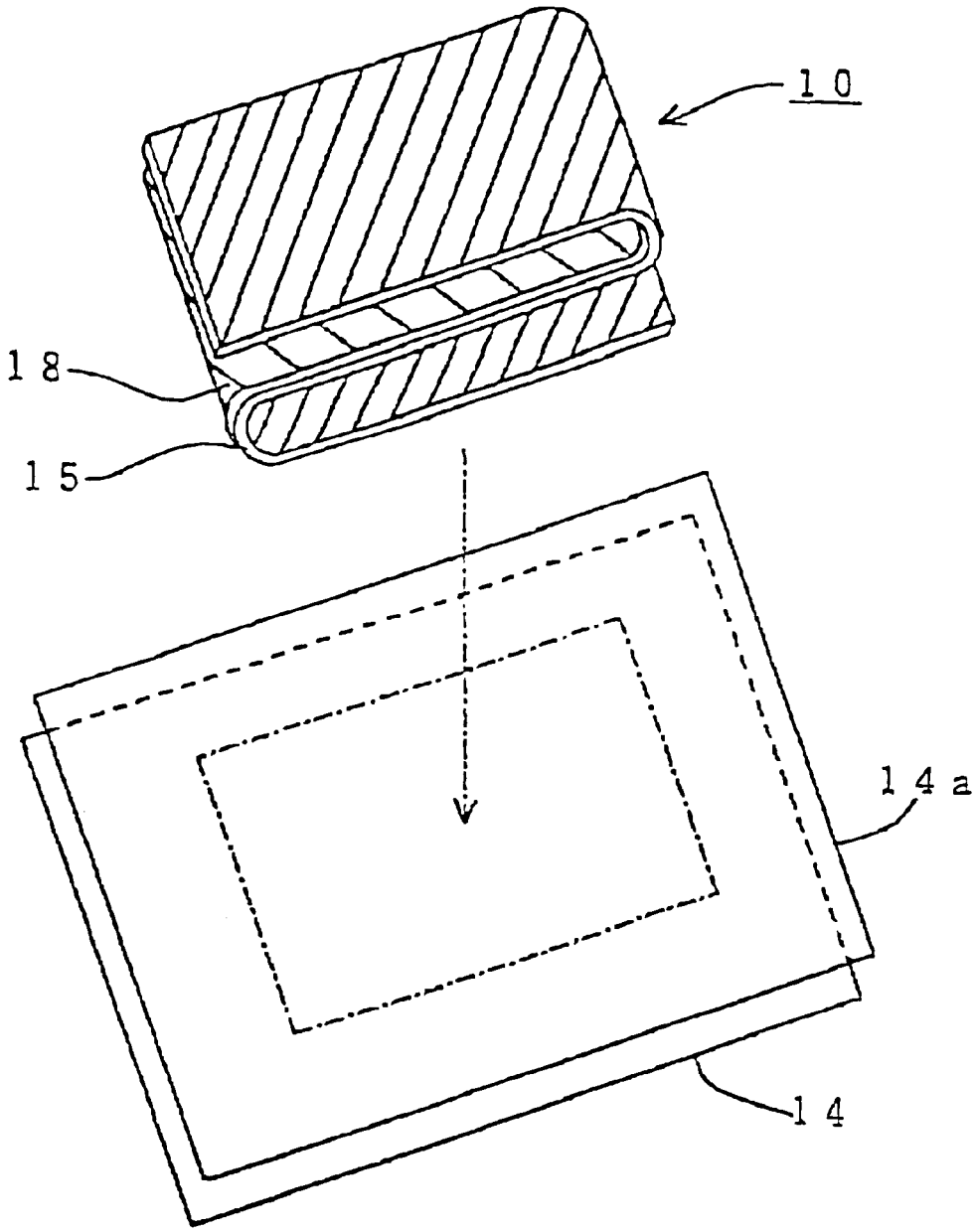
FIG. 1 is an exploded perspective view of a combustion promoting device of an embodiment according to the present invention.
Figure 2:
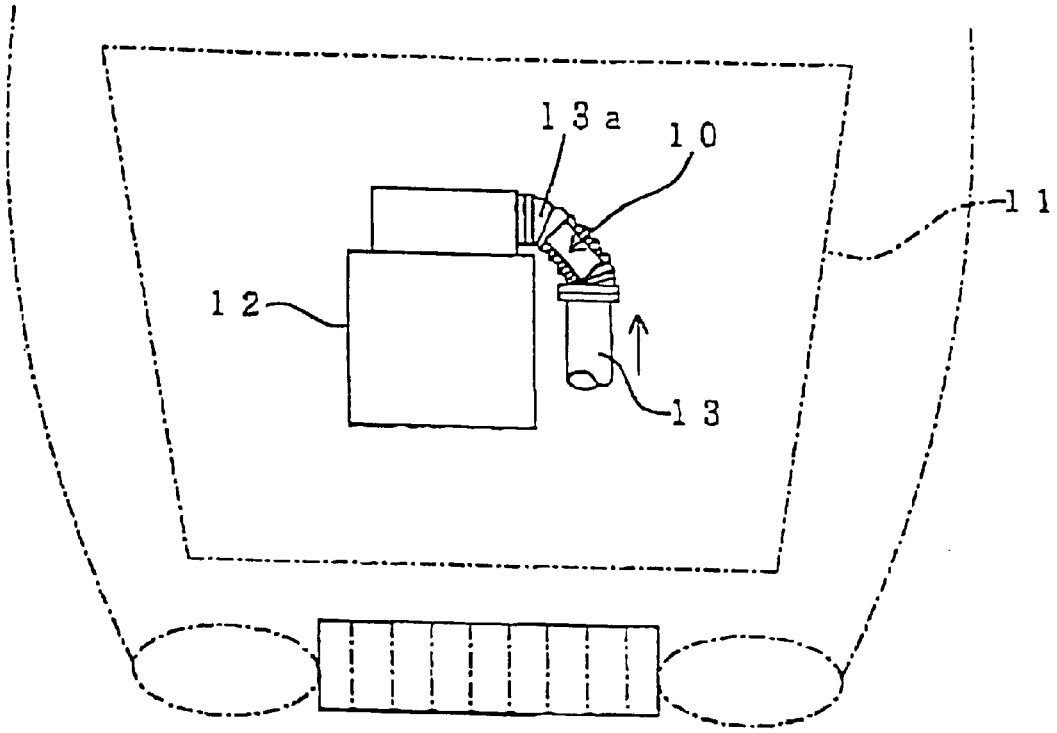
FIG. 2 is a schematic planar view showing how a combustion promoting device of an embodiment according to the present invention is used.
Figure 3:
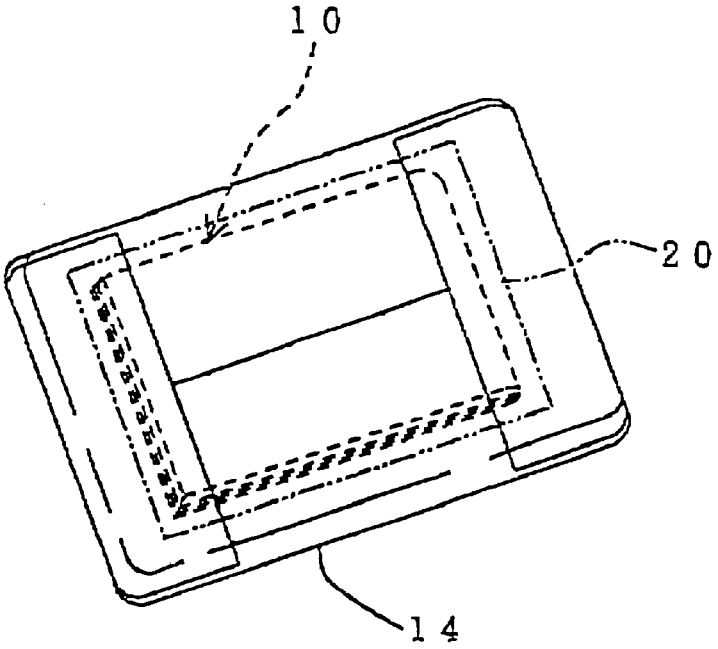
FIG. 3 is a perspective view of a combustion promoting device of an embodiment according to the present invention.
Figure 4:
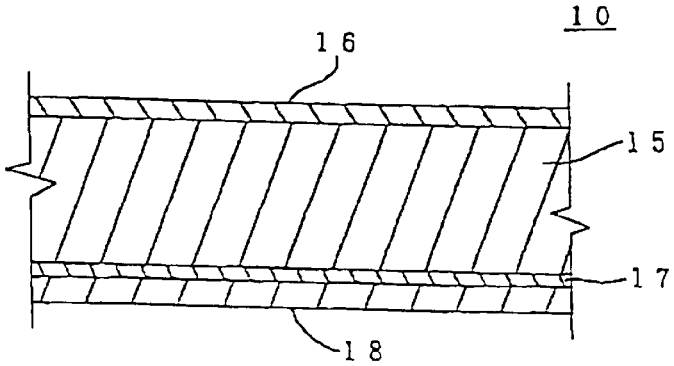
FIG. 4 is an enlarged sectional view of a main portion of a combustion promoting device of an embodiment according to the present invention.
Figure 5A:
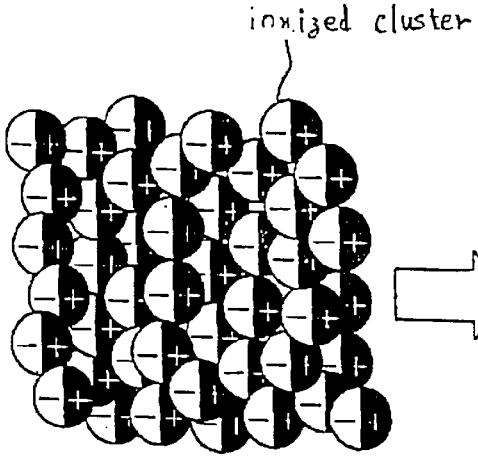
FIG. 5 is a schematic view illustrating a process how ionized clusters in the air are dispersed and made into fine particles by positive ions emitted from ceramic and titanium oxide, wherein the reference numerals 10, 12, and 15 designate a combustion promoting device, as engine (a combustion equipment, an internal engine) and a glass cloth (a substrate) respectively.
Figure 5B:
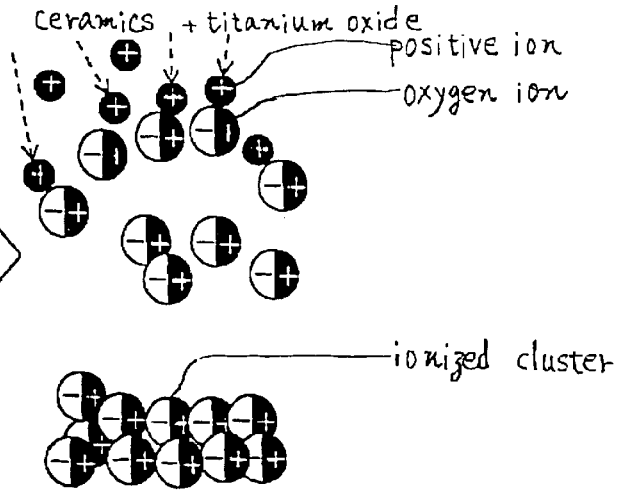
Figure 5C:
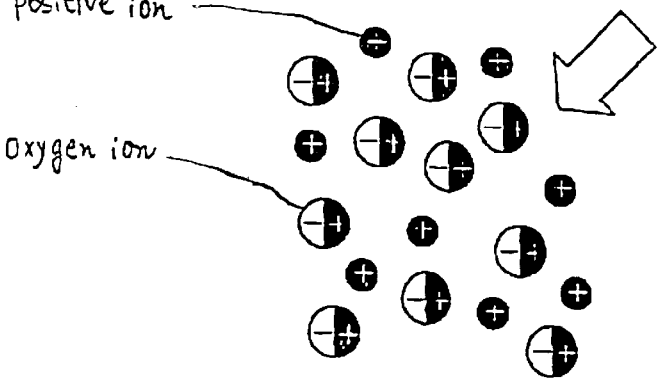

FIG. 1 is an exploded perspective view of a combustion promoting device of an embodiment according to the present invention. FIG. 2 is a schematic planar view showing how a combustion promoting device of an embodiment according to the present invention is used. FIG. 3 is a perspective view of a combustion promoting device of an embodiment according to the present invention. FIG. 4 is an enlarged sectional view of a main portion of a combustion promoting device of an embodiment according to the present invention. FIG. 5 is a schematic view illustrating a process how ionized clusters in the air are dispersed and made into fine particles by positive ions emitted from ceramic and titanium oxide.

In FIG. 2, the reference numeral 10 shows a combustion promoting device according to the present invention, and this combustion promoting device 10 is detachably stuck to an outer face of a bellows rubber hose 13*a* of an air intake duct (induction system) 13 of an engine 12 installed in an engine compartment 11 of a vehicle. The combustion promoting device 10 will hereafter be detailed with the reference to FIGS. 1, 3, and 4.

The combustion promoting device 10, as shown in FIGS. 1 and 3, is wrapped by a packaging metal film 14, which has on its back a separation paper 14*a*, whose thickness is 100 μm, whose size is 90 mm×90 mm and which is made by Rintech Company.

As shown in FIG. 4, the combustion promoting device 10 has a glass cloth 15 (1 mm in thickness, 40 mm in width, and 195 mm in total length), which has a substrate of twill-woven glass fiber and has a vapor-deposited aluminum film 16 of 100 μm thickness on its one side and is folded in three.

As a concrete glass cloth 15 having a aluminum film 16, an aluminum twill-woven glass cloth adhesive tape (heat resistant temperature 180° C.) made by Japan Glass Fiber Company is employed. A glass cloth with no aluminum film 16 vapor-deposited may also be employed. For example, Nitofron adhesive tape (973UL) made by Nitto Denko Corp. is such one. Nitofron (product name) is a porous membrane of ethylene tetra-fluoride resin which allows such gases as air, steam to pass through but does not usually allow solid fine particles and such liquids having a wide contact angle as water, sulfuric acid to pass through. The tape is 0.13 to 0.18 in thickness and 10 to 450 mm in width. Tyuko Flow adhesive tape (AGF-100/AGF-100A, heat resistant temperature 200° C./250° C., respectively) made by Tyuko Chemical Company may be employed. These tapes are PTFE-impregnated glass cloths. Such other cloths as Valfron (product name; Valfron 7910, 7925; made by Nihon-Valqua Industries, Ltd.), "Permacel" (product name), glass cloth made by Asahi Glass Co., Ltd., glass cloth of Toshiba Ceramics Co., Ltd. may be employed.

Supertherm (sales product name in Japan; Ceramotherm) made by Superior Product Company in the US is applied onto the surface of said aluminum membrane 16. The applied amount herein is about 1 g/cm$^2$, but is not restricted thereto. Supertherm is a heat insulative coating agent comprising a base of organic urethane emulsion and acrylic resin emulsion and being compounded with 700 kinds of ceramics. Supertherm includes 6 weight percent of titanium oxide as constituent. Since Supertherm is spray-applied, it is easy to handle.

On the other hand, using a heat resistant double-faced adhesive tape 17 made by Nitto Denko Corp., a sheet of copper foil 18 of 200 μm (or 300 μm) in thickness is stuck onto the other surface of this glass cloth 15. In stead of this copper foil 18, a copper piece may be wound up into the folded glass cloth 15.

It will hereafter be described how to use this combustion promoting device.

To sue this combustion promoting device 10, a vehicle bonnet is opened as shown in FIG. 2, and the combustion promoting device 10 is stuck to the outer surface of a bellows rubber hose 13*a* of a air intake duct 13 of an engine 12, using a heat resistant double-faced adhesive tape 20 (refer to FIG. 3). Then, when the engine 12 is driven, the ionized clusters in the air supplied through an induction duct 13 into a combustion chamber of the engine 12 are neutralized by the ceramic and titanium oxide of the combustion promoting device 10.

That is, various ionized clusters constituting the air, especially the ionized clusters of oxygen are neutralized by the ceramic and titanium oxide. Through this neutralization, these ionized clusters are dispersed and made into fine particles (refer to FIGS. (*a*) to (*c*)).

Consequently, ionized clusters of oxygen which reacts with gasoline (fuel) and causes the combustion reaction are dispersed and made into fine particles, and this enhances the combustion efficiency of the engine 12 and results in improved fuel economy and higher power. Further this higher power leads to an improved accelerability of the engine 12, which in turn prevents the degradation in the instantaneous passing ability or the speed down at an upward slope. Further the engine noise is reduced and the black smoke contained in the exhaust gas is drastically reduced, and thereby the content of harmful substances such as NOx, SOx, HC is also reduced. Therefore this can contribute to the environment preservation. Furthermore, the life of the engine 12 is made longer.

A result in an actual vehicle running test, conducted by the inventor, using an embodiment of this combustion promoting device is hereafter described.

First is described a measurement result in a test in which how much black smoke is exhausted from a Nissan Gloria equipped with a diesel engine (2800 cc). A smoke tester made by Baccaruck Company was used for this measurement. Before installing a combustion promoting device 10, the content of black smoke in the exhaust gas was 47% with respect to a specified amount. After installing a combustion promoting device 10, the content of black smoke was reduced to 23%.

Then a test was conducted to measure hydrocarbon (HC) in the exhaust gas. In this test a motor bicycle of Honda supercab (50 cc) was used. The HC in the exhaust gas was 480 ppm before installing the device. The HC after installing the device was reduced by 190 ppm to 290 ppm. The measuring instrument in this inspection was CO-HCC ANALYZERALTAS-1000 made by IYASAKA Company.

Then gasoline-powered car with a combustion promoting device 10 equipped was rendered to a test by a foundation, Japan Automobile Transport Technology Association to examine how the exhaust gas was improved.

The conducted tests were an exhaust gas test at idle before and after installing a combustion promoting device 10 into an air cleaner, and an exhaust gas test at Japan 10 mode for a gasoline-powered car.

The conducted tests were an exhaust gas test at idle before and after installing a combustion promoting device 10 into an air cleaner, and an exhaust gas test at Japan 10 mode for a gasoline-powered car.

The tested car had such specifications as Model name/type; Toyota E-GX81, Registered number; Kyoto 53 U9540, Vehicle identification number; GX81-3301780, Category/usage; small passenger car, Engine type; 1 G, Cycle/number of cylinders; 4 cycle/6 cylinders, Displacement; 1988 cc, Max power; 135PS/5600 rpm, Normal idle engine rev; (N) 700±50 rpm, category of anti-pollution measure; three way catalyst+$O_2$ sensor, Fuel category; lead-free gasoline, idle ignition timing; 10 deg/700 BTDC, Transmission; Automatic (4 stages forward), FGR; 4.100, Vehicle weight; 1360 kg, Tested vehicle weight; 1470 kg, Equivalent inertia weight; 1500 kg.

The measuring instruments used in the test were a chassis dynamometer (RDDY, type-1210, made by Horiba, Ltd.), an exhaust analyzer (MEXA, type-8420, made by Horiba, Ltd.), and an exhaust gas sampler (CVS, type-1900, made by Horiba, Ltd.).

Table 1 shows a result of the exhaust gas at idle test. Table 2 shows a result of the exhaust gas and fuel consumption at 10 mode test.

TABLE 1

Result of Exhaust Gas Test at Idle

| item | before installed | | after installed | |
|---|---|---|---|---|
| test date | May 12, 1999 (weather fine) | | May 12, 1999 (weather fine) | |
| total mileage before test (km) | 92603 | | 92635 | |
| test room | | | | |
| atom. pressure mm Hg | 760.4 | | 760.0 | |
| temp | | | | |
| dry bulb ° C. | 24.2 | | 24.8 | |
| wet bulb ° C. | 17.8 | | 18.2 | |
| relative humidity % | 53 | | 53 | |
| test car | | | | |
| coolant temp ° C. | 87 | | 86 | |
| lubricant temp ° C. | 96 | | 99 | |
| exhaust gas | | | | |
| gear position | N | D | N | D |
| engine revolution rpm | 694 | 592 | 699 | 617 |
| induction pressure mmHg | 539 | 434 | 541 | 488 |
| * | | | | |
| measured value (NDIR) | | | | |
| CO % | 0.08 | 0.01 | 0.05 | 0.01 |
| HC ppm | 114 | 10.3 | 88.0 | 12.0 |
| $CO_2$ % | 14.2 | 13.8 | 14.2 | 13.9 |
| corrected conc. | | | | |
| CO % | — | — | — | — |
| HC ppm | — | — | — | — |

*constituent

TABLE 2

Exhaust Gas and Fuel Consumption at Japan 10 Mode Test

| item | before installed | | | | before installed | | | |
|---|---|---|---|---|---|---|---|---|
| date of test | May 12, 1999 (weather fine) | | | | May 12, 1999 (weather fine) | | | |
| total mileage after test km | 92603 | | | | 92635 | | | |
| test room | | | | | | | | |
| atom. pressure | 760.4 | | | | 760.0 | | | |
| temp | | | | | | | | |
| dry ° C. | 25.4–24.2 | | | | 24.6–24.4 | | | |
| wet ° C. | 18.8–17.8 | | | | 18.4–17.8 | | | |
| humidity % | 53 | | | | 54 | | | |
| test car | | | | | | | | |
| coolant temp ° C. | 86–86 | | | | 86–87 | | | |
| lubricant temp ° C. | 95–96 | | | | 97–96 | | | |
| * | | | | | | | | |
| speed (Km/h) | 20 | 40 | 60 | | 20 | 40 | 60 | |
| resistance kg | 23.8 | 29.2 | 38.1 | | 23.8 | 29.2 | 38.1 | |
| KH (humidity correction factor) | 0.989 | | | | 0.986 | | | |
| constituent | CO | HC | CO | $CO_2$ | CO | HC | CO | $CO_2$ |
| measuring method | ppm (NDIR) | ppmC (FID) | ppm (CLD) | % (NDIR) | ppm (NDIR) | ppmC (FID) | ppm (CLD) | % (NDIR) |
| diluted exhaust gas concentration | 54.5 | 18.48 | 19.88 | 0.70 | 45.4 | 12.85 | 16.57 | 0.77 |
| diluted air concentration | 0.9 | 2.36 | 0.05 | 0.04 | 0.7 | 2.15 | 0.04 | 0.05 |

TABLE 2-continued

| Exhaust Gas and Fuel Consumption at Japan 10 Mode Test | | | | | | | | |
|---|---|---|---|---|---|---|---|---|
| item | before installed | | | | before installed | | | |
| net conc. | 53.65 | 16.24 | 19.83 | 0.66 | 44.74 | 10.81 | 16.53 | 0.72 |
| exhausted weight | 1.32 | 0.20 | 0.79 | 255 | 1.11 | 0.14 | 0.66 | 251 |
| sample amount $m^3$/min | 6.21 | | | | 6.21 | | | |
| fuel consumption (carbon balance) km/l | 9.2 | | | | 9.4 | | | |

*running resistance setting value for chassis dynamometer

As obviously seen in Tables 1 and 2, CO, NOx, and HC in the exhaust gas were reduced by installing the combustion promoting device 10. Especially, the reduction was remarkable at 10 mode.

According to the present invention, since ceramic and titanium oxide are attached to a heat resistant substrate, they neutralizes ionized clusters of a combustible fluid, disperse and make the clusters into fine particles, the combustion efficiency of a combustion equipment is enhanced. Accordingly the content of harmful substances such as Nox, SOx, HC is reduced and the life of the combustion equipment is made longer.

In particular, according to the invention described in claim 1, since a combustion promoting device is attached to an induction system of an internal combustion engine, ionized clusters of various atoms and molecules constituting the air, especially ionized clusters of oxygen, are dispersed and made into fine particles, and consequently the combustion efficiency is enhanced and thereby the fuel economy and the power of the internal combustion engine can be improved.

As many apparently widely different embodiments of this invention may be made without departing from the spirit and scope thereof, it is to be understood that the invention is not limited to the specific embodiments thereof except as defined in the appended claims.

What is claimed is:

1. A combustion promoting device comprising at heat resistant substrate with ceramic and titanium oxide attached thereto for dispersing ionized clusters of cohering atoms or molecules charged with electricity and for making said ionized clusters into fine particles, said ionized clusters constituting a combustible fluid to be supplied into a combustion equipment and to cause a combustion reaction, said substrate being coated with a thin aluminum film.

2. A combustion promoting device comprising a heat resistant substrate with ceramic and titanium oxide attached thereto for dispersing ionized clusters of cohering atoms or molecules charged with electricity and for making said ionized clusters into fine particles, said ionized clusters constituting a combustible fluid to be supplied into a combustion equipment and to cause a combustion reaction, said substrate being coated with a thin copper film.

3. A combustion promoting device comprising a heat resistant substrate with ceramic and titanium oxide attached thereto for dispersing ionized clusters of cohering atoms or molecules charged with electricity and for making said ionized clusters into fine particles, said ionized clusters constituting a combustible fluid to be supplied into a combustion equipment and to cause a combustion reaction, said substrate being coated with a thin aluminum film and a thin copper film.

* * * * *